US006326545B1

(12) United States Patent
Daoud

(10) Patent No.: US 6,326,545 B1
(45) Date of Patent: Dec. 4, 2001

(54) HIGH DENSITY DISTRIBUTION PANEL HAVING FRONT ACCESSIBLE ELECTRICAL COMPONENTS

(75) Inventor: Bassel Hage Daoud, Parsippany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/495,995

(22) Filed: Feb. 1, 2000

(51) Int. Cl.[7] ..... H01R 13/46
(52) U.S. Cl. ..... 174/59; 439/910
(58) Field of Search ..... 174/59, 35 C, 174/135, 52.1, 52.4, 58, DIG. 9; 439/910

(56) References Cited

U.S. PATENT DOCUMENTS 5,898,129 * 4/1999 Ott et al. ..... 174/DIG. 9 X
6,060,661 * 5/2000 O'Neill ..... 174/58
6,111,196 * 8/2000 Arai ..... 174/DIG. 9 X
6,133,526 * 10/2000 Lebo et al. ..... 174/58
6,147,304 * 11/2000 Doherty ..... 174/48
6,166,329 * 12/2000 Oliver et al. ..... 174/58
6,172,300 * 1/2001 Kawaguchi ..... 174/59

* cited by examiner

*Primary Examiner*—Dean A. Reichard
*Assistant Examiner*—Dhiru R Patel
(74) *Attorney, Agent, or Firm*—Howard C. Miskin; Gloria Tsui-Yip

(57) ABSTRACT

A high density distribution panel is disclosed having a plurality of drawers on which components are mounted. The drawers provide support for the components and are pulled out and allowed to be guided downward with the assistance of gravity to come to rest against appropriate support and also to provide front access of the components mounted on the drawers. The appropriate support accommodates the use of downwardly initiated press action of sufficient force to provide for good electrical connections of associated electrical conductors, which includes optical and electrical cables.

13 Claims, 11 Drawing Sheets

HIGH DENSITY DISTRIBUTION PANEL HAVING FRONT ACCESSIBLE ELECTRICAL COMPONENTS

FIELD OF THE INVENTION

This invention relates to a telecommunication apparatus, in particular to a high density distribution panel having slidable and rotatable drawers that provide front access to electrical components mounted on the drawers.

BACKGROUND OF THE INVENTION

Telecommunication establishes communication, usually between widely separated points, by electrical or electronic means. The initial establishing of communication commonly involves installing a distribution panel whereby lines of a subscriber are electrically connected to a communication provider, such as a telephone provider. In buildings where multiple subscribers are located, the distribution panel usually takes the form of a building entrance protector (BEP) which is commonly flush mounted along its X-Y axes (vertical-horizontal orientations) on a wall in the basement of a building. All forms of distribution panels usually require the need of a press action for interconnecting the electrical wires or optical cables of a distribution panel. The press action may be relatively severe in order that the optical or electrical conductor has sufficient pressure applied thereto to force the conductor into its waiting terminal and establish a good electrical connection therebetween. Therefore, terminals mounted on the distribution panel are preferably mounted on the X-Y plane, parallel to the wall on which the panel is mounted, to provide adequate support for the pressing action. However, the number of terminals mounted on the X-Y plane is limited to the size of the panel. Although prior art units provide additional layers of distribution panels foldably stacked on top of each other, the accessibility to terminals on different layers are hindered.

Therefore, it is desired that a high-density distribution panel be provided with a relatively rigid support so that the press action necessary to establish good electrical connections of its electrical conductors may be accomplished. In addition to providing appropriate support to establish its electrical connections, it is desired that the distribution panel provide front access of its electrical components so as to ease the burden of the servicing technician to provide for the necessary electrical interconnections and to also allow the servicing technician to be able to see all connections so as to facilitate the maintenance and addition of all of the necessary electrical connections of the distribution panel.

SUMMARY OF THE INVENTION

The invention provides a distribution panel having a plurality of drawers on which components are mounted. The drawers provide for mounting a high density of components and pull out so as to be allowed to rotate downward assisted by gravity to provide front access to the electrical components and a rigid support for adding and removing connections to the components.

The distribution panel has X-Y-Z axes, in a vertical-horizontal-depth orientation respectively, and services a multiplicity of subscribers and holds electrical components. The distribution panel comprises a fixture and at least one drawer. The fixture is rigidly mounted to the distribution panel and has at least one side with at least one slot running along the Z-axis (depth) of the distribution panel and having a first and a second end. The at least one drawer is capable of being gripped and has the electrical components mounted thereon. The at least one drawer has oppositely opposed spaced apart inner and outer surfaces and is arranged in the fixture so as to run along the Z axis (depth) of distribution panel and has its electrical components mounted on the inner surface. The at least one drawer has an attached pin inserted into the first end of the slot and is dimensioned so as to be capable of moving in the slot from the first end to the second end. In operation, the at least one drawer is capable of being pulled along the Z axis (depth) causing the pin to move from the first end to the second end where the at least one drawer drops downward assisted by gravity toward the X axis (vertical) of the distribution panel and rotates about the pin so that the electrical components mounted thereon lie on the X-Y plane.

It should be appreciated for the purpose of illustration these Figures are not necessarily drawn to scale.

DETAILED DESCRIPTION OF THE PREFERRED EMBODIMENTS

Figure 1:
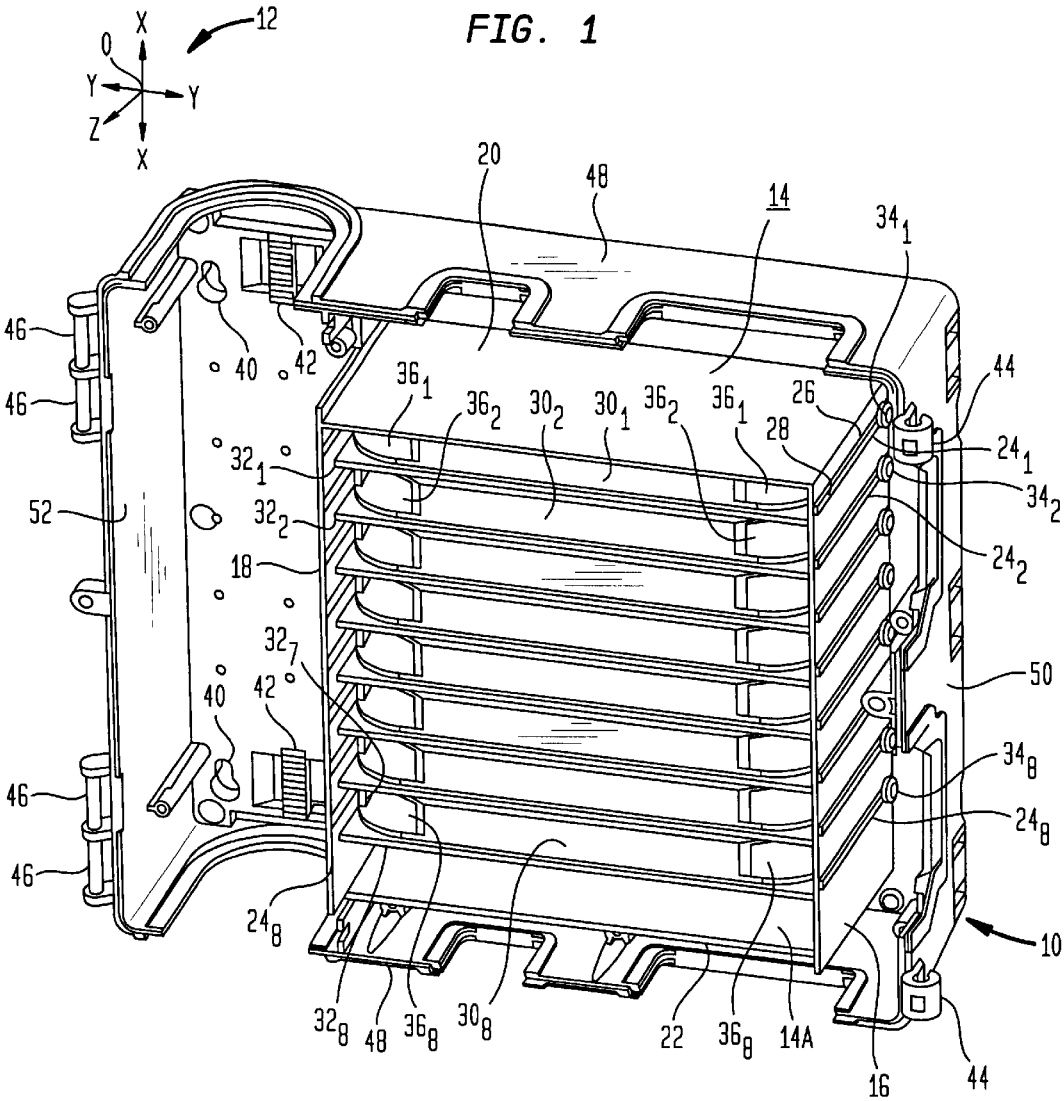
FIG. 1 is a perspective view of the distribution panel of the present invention.

With reference to the drawing wherein the same reference number illustrates the same element throughout, FIG. 1 illustrates a distribution panel 10 serving as a building entrance panel (BEP) that provides for rigid support of its electrical components and front access thereto.

The distribution panel 10 services a multiplicity of subscribers of a communication provider, such as a telephone provider and has an X-Y-Z-axes orientation 12, defining the vertical-horizontal-depth orientation respectively, whereby the distribution panel 10 is flush mounted along the X-Y plane (vertical-horizontal) on a wall. The distribution panel 10 comprises a housing and a fixture 14 that is rigidly mounted to the main portion of the distribution panel 10 in a manner known in the art and has at least one side 16, but preferably oppositely disposed sides 16 and 18 as well as side portions 20 and 22. Each of the oppositely disposed sides 16 and 18 has at least one, but preferably a plurality of slots $\mathbf{24}_1$, $\mathbf{24}_2$, . . . $\mathbf{24}_8$, running along the Z axis (depth) of the distribution panel and each having first and second ends 26 and 28 respectively.

The distribution panel 10 further comprises at least one, but preferably a plurality of drawers $\mathbf{30}_1$, $\mathbf{30}_2$, . . . $\mathbf{30}_8$, that are adjacently located relative to each other and are preferably separated by dividers $\mathbf{32}_1$, $\mathbf{32}_2$, . . . $\mathbf{32}_8$. The plurality of drawers $\mathbf{30}_1$, $\mathbf{30}_2$, . . . $\mathbf{30}_8$, take advantage of the depth of the distribution panel along the Z-axis (depth) to allow a plurality of electrical components to be mounted thereon for easy access, without being limited to the size of the X-Y plane of the distribution panel, to be further illustrated with reference to FIG. 10. The fixture 14 further has a provision 14A for providing for the operational mounting of an additional drawer (not shown).

Each of the drawers $\mathbf{30}_1$, $\mathbf{30}_2$, . . . $\mathbf{30}_8$, has corresponding pins $\mathbf{34}_1$, $\mathbf{34}_2$, . . . $\mathbf{34}_8$, mounted on opposite sidewalls 38 of each drawer $\mathbf{30}_1$, $\mathbf{30}_2$, . . . $\mathbf{30}_8$ (best shown in FIGS. 4 and 6). The pins $\mathbf{34}_1$, $\mathbf{34}_2$, . . . $\mathbf{34}_8$, are inserted into the first end 26 of their respective slot $\mathbf{24}_1$, $\mathbf{24}_2$, . . . $\mathbf{24}_8$ and are dimensioned so as to be capable of moving in their respective slot. Each of the drawers $\mathbf{30}_1$, $\mathbf{30}_2$, . . . $\mathbf{30}_8$, have respective openings $\mathbf{36}_1$, $\mathbf{36}_2$, . . . $\mathbf{36}_8$ that are located at both ends of the drawer $\mathbf{30}_1$, $\mathbf{30}_2$, . . . $\mathbf{30}_8$ as shown in FIG. 1.

In general, each of the drawers $\mathbf{30}_1$, $\mathbf{30}_2$ . . . $\mathbf{30}_8$ is arranged in the fixture 14 so as to run along said Z axis (depth) of distribution panel 10 and has its electrical components mounted on the inner surface to be further described with reference to FIG. 7. The drawer $\mathbf{30}_1$, $\mathbf{30}_2$ . . . $\mathbf{30}_8$ is capable of being slid or pulled along the Z axis (depth) causing its pin 34, to move from the first end 26 to the second end 28 where the drawer $\mathbf{30}_{1,\ 302}$ . . . $\mathbf{30}_8$ drops downward, assisted by gravity, toward the X axis (vertical) of the distribution panel 10 and rotates about the pin $\mathbf{34}_1$, $\mathbf{34}_2$ . . . $\mathbf{34}_8$. The weight of the electrical components mounted on the inner surface of the drawers $\mathbf{30}_1$, $\mathbf{30}_2$ . . . $\mathbf{30}_8$ further assists in the downward movement of the drawers $\mathbf{30}_1$, $\mathbf{30}_2$ . . . $\mathbf{30}_8$.

The distribution panel 10 further has support mounts 42 for accommodating cable runs, and hook arrangements 44 and hinge arrangements 46 so as to allow a cover (not shown) or another distribution panel 10 having complementary provisions in a manner known in the art to be stack mounted thereon. Further, the distribution panel 10 has openings 40 that assist in the distribution panel being flush mounted to a wall. The distribution panel 10 has oppositely disposed side portion 48, a top portion 50, and a bottom portion 52. The side portion 48 may be further described with reference to FIG. 2.

Figure 2:
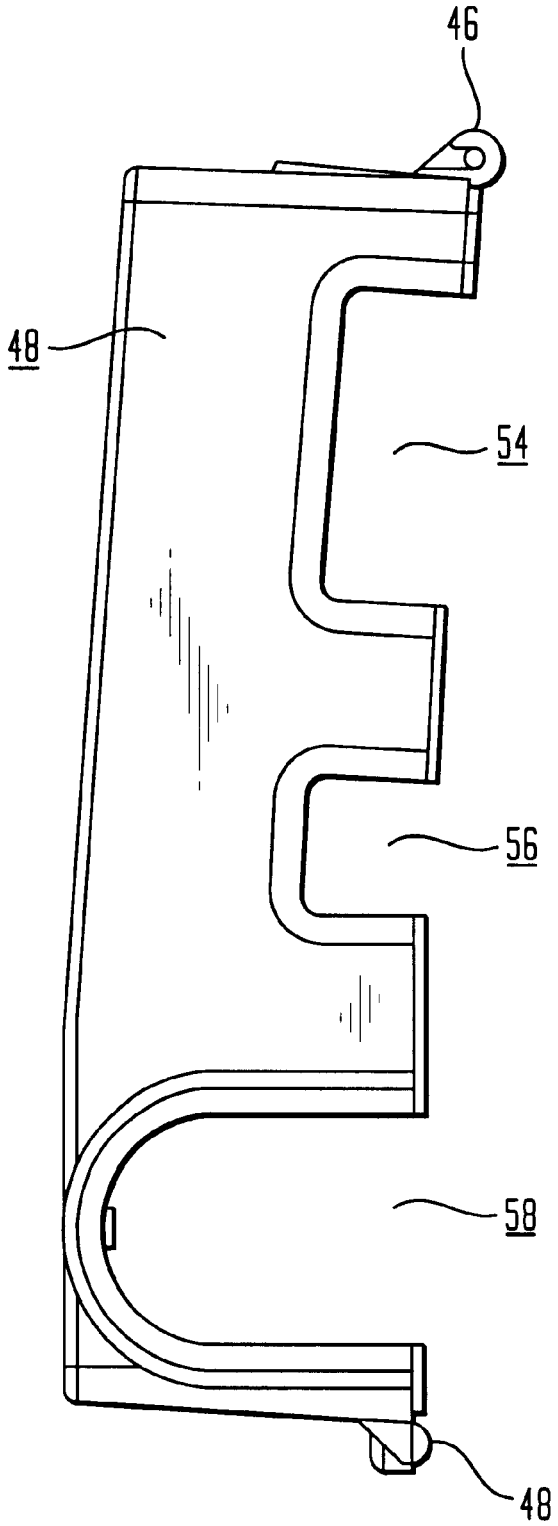
FIG. 2 illustrates a side view of the distribution panel of FIG. 1.

FIG. 2 illustrates the side portion 48 of the sidewalls of the distribution panel 10 as having openings 54, 56, and 58 that allow for ingress and egress of cable runs to be further described with reference to FIG. 9. The top portion 50 also has openings for ingress and/or egress of cable runs and may be further described with reference to FIG. 3.

Figure 3:
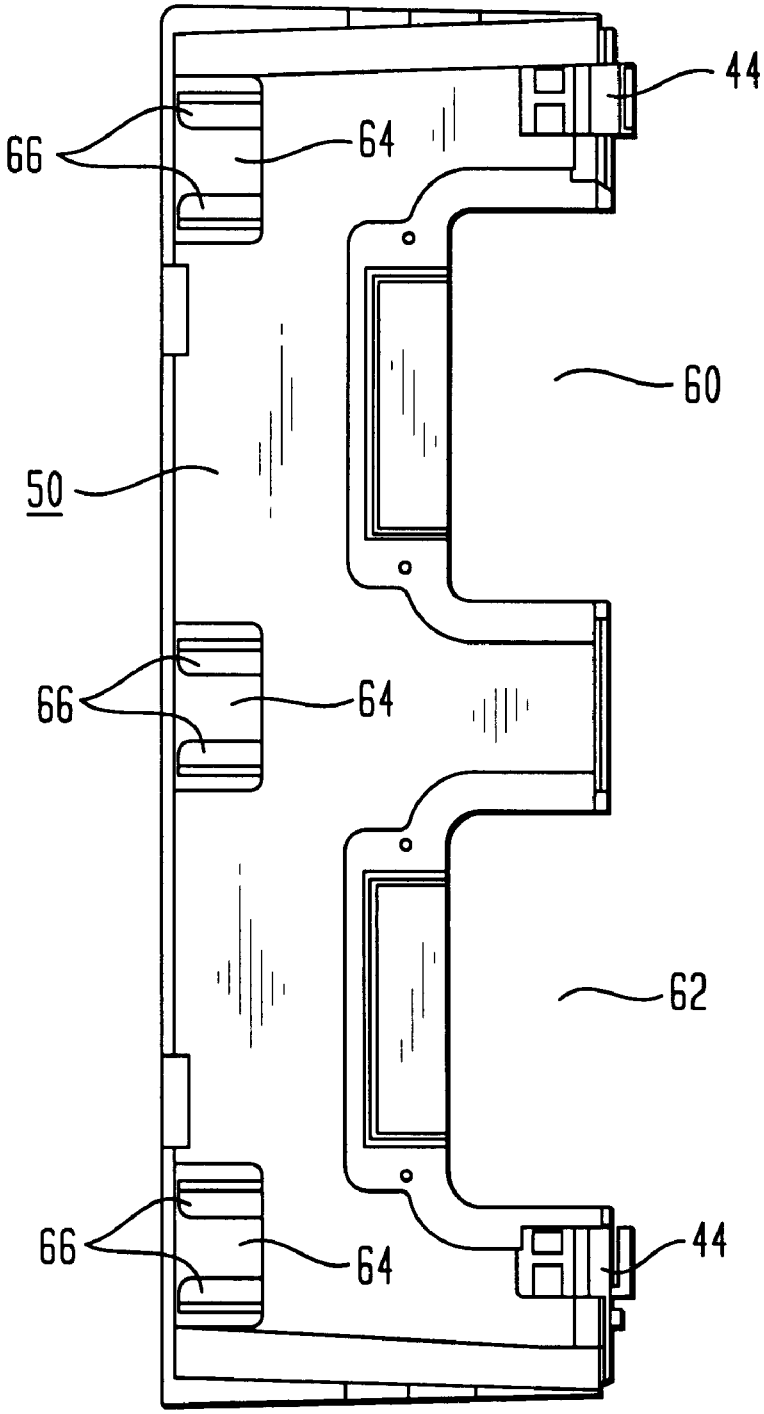
FIG. 3 illustrates the top view of the distribution panel of FIG. 1.

As shown in FIG. 3 the top portion 50 of the sidewalls of the distribution panel 10 has openings 60 and 62 to accommodate cable runs of the distribution panel 10. Further, the top portion 50 has sections 64 having opening 66 that allow for the moving and manipulation of the distribution panel 10. Further details of the distribution panel 10 may be further described with reference to FIG. 4.

Figure 4:
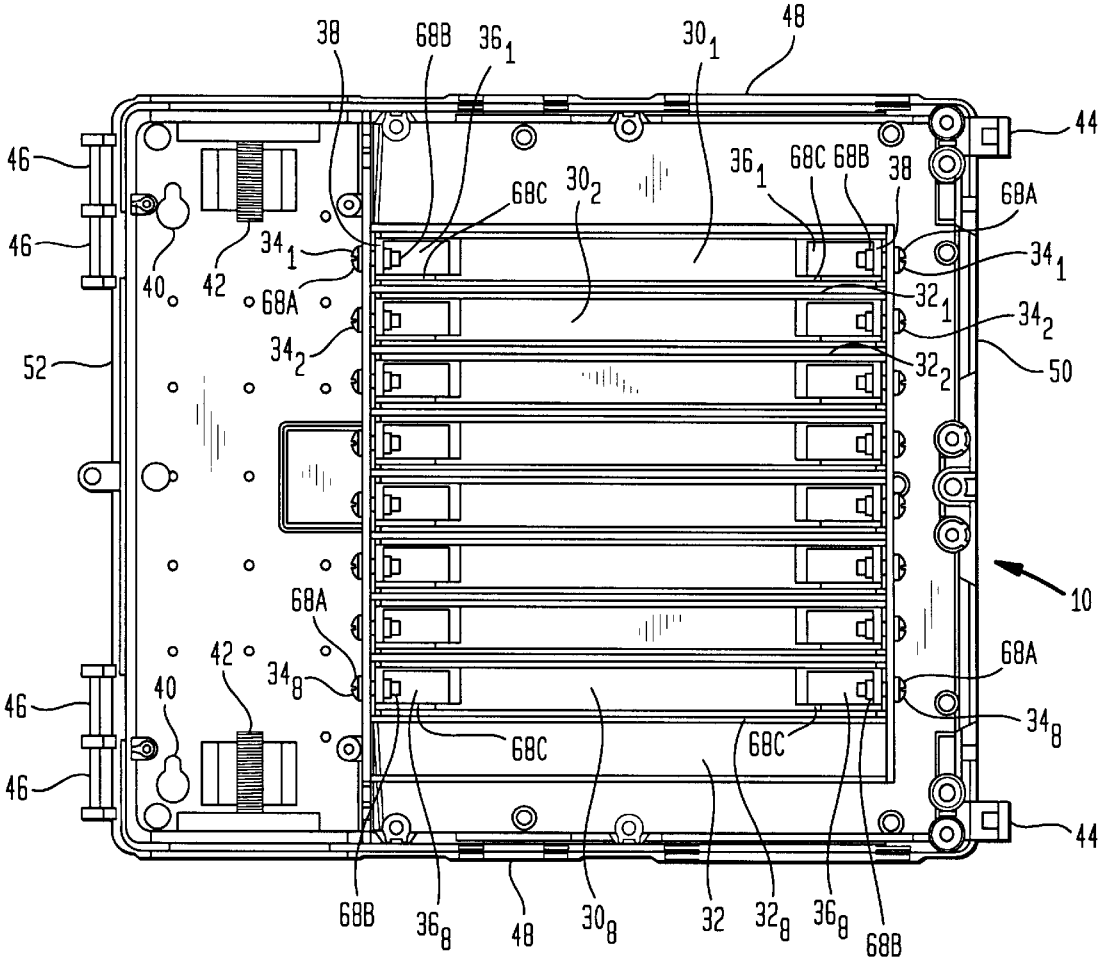
FIG. 4 is a front view of the distribution panel of FIG. 1.

FIG. 4 is a front elevational view of the distribution panel 10 of FIG. 1 and illustrates more details thereof. More particularly, FIG. 4 illustrates that the pin, such as $\mathbf{34}_1$ has a top section 68A, which has a configuration to accept a tighten tool, such as a screw driver 68A, and is interconnected to the respective drawer $\mathbf{30}_1$, $\mathbf{30}_2$, . . . $\mathbf{30}_8$ by a clamp arrangement 68B. Further. FIG. 4 illustrates that the structure holding the pin $\mathbf{34}_1$, $\mathbf{34}_2$, . . . $\mathbf{34}_8$, is separated from the remaining structure of the respective drawers $\mathbf{30}_1$, $\mathbf{30}_2$ . . . $\mathbf{30}_8$ by a separation region 68C so that the respective drawer $\mathbf{30}_1$, $\mathbf{30}_2$, . . . $\mathbf{30}_8$, may rotate relative to its respective pin $\mathbf{34}_1$, $\mathbf{34}_2$, . . . $\mathbf{34}_8$, in a manner as to be further described with reference to FIG. 6. Other details of the distribution panel of FIG. 1 may be further described with reference to FIG. 5.

Figure 5:
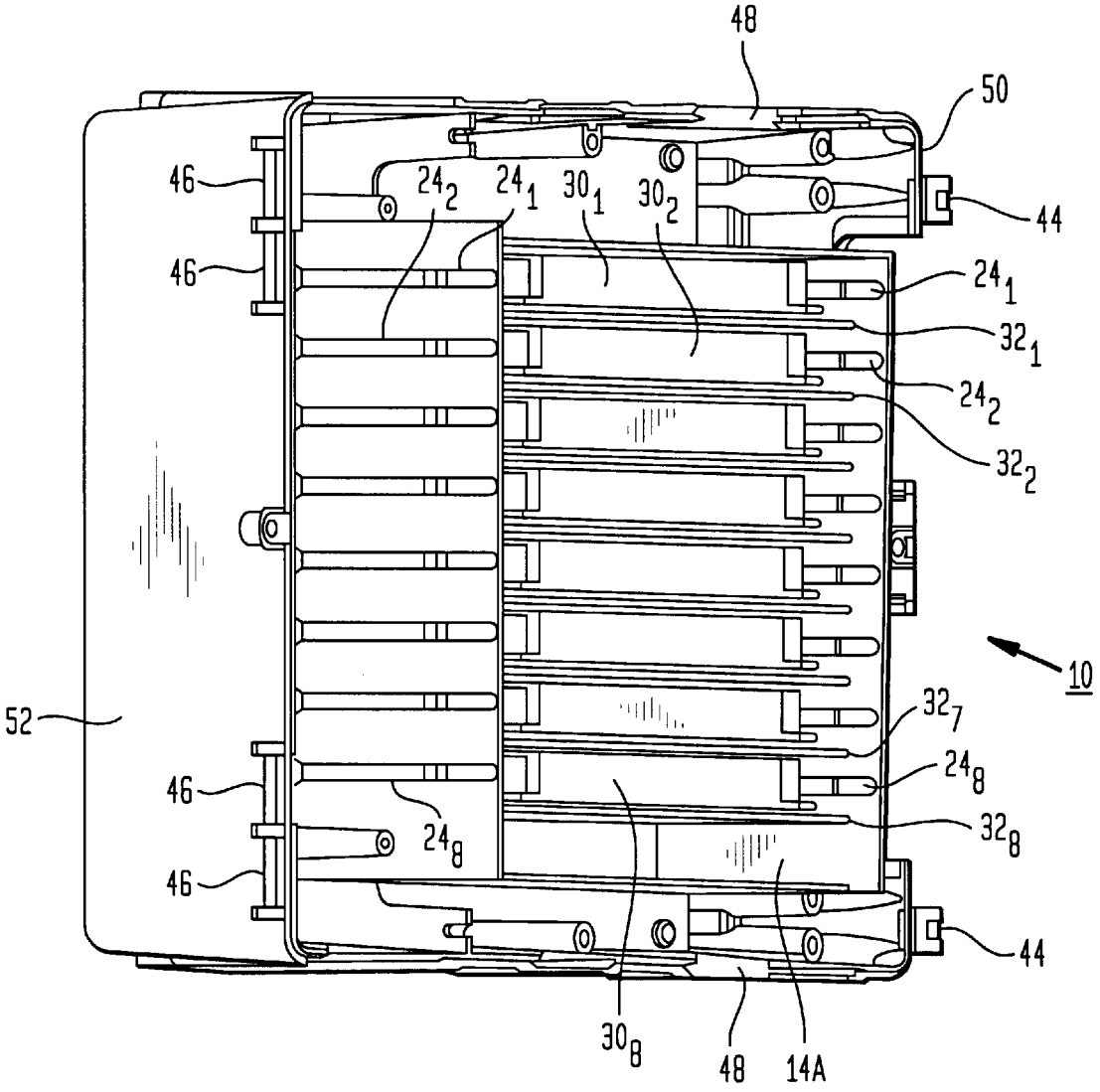
FIG. 5 illustrates the depth dimension of the distribution panel of FIG. 1.

FIG. 5 illustrates the depth dimension of the distribution panel 10. More particularly, FIG. 5 illustrates the depth of the slots $\mathbf{24}_1$, $\mathbf{24}_2$, . . . $\mathbf{24}_8$, that run along the Z-axis (depth) of the distribution panel 10. Further, FIG. 5 illustrate that the drawers $\mathbf{30}_1$, $\mathbf{30}_2$, . . . $\mathbf{30}_8$, are respectively separated by the dividers $\mathbf{32}_1$, $\mathbf{32}_2$, . . . $\mathbf{32}_8$. Further, a divider $\mathbf{32}_8$ is provided so as to accommodate, if desired, the mounting of an additional drawer in the region 14A. The operation of all the drawers $\mathbf{30}_1$, $\mathbf{30}_2$, . . . $\mathbf{30}_8$, may be described with reference to FIG. 6.

FIG. 6 is composed of FIGS. 6(A), 6(B), 6(C), and 6(D) that cumulatively and schematically illustrate the operation of the present invention in which components, mounted on the inner drawers $\mathbf{30}_1$, $\mathbf{30}_2$, . . . $\mathbf{30}_8$, are provided with substantial back support as well as front accessibility. In general, the operation involves gripping and moving each selected drawer $\mathbf{30}_1$, $\mathbf{30}_2$ . . . $\mathbf{30}_8$ so that the respective pin $\mathbf{34}_1$, $\mathbf{34}_2$, . . . $\mathbf{34}_8$, is moved from its first end 26 to its second end 28 and the drawer $\mathbf{30}_1$, $\mathbf{30}_2$ . . . or $\mathbf{30}_8$, is then allowed to rotate about its respective pin $\mathbf{34}_1$, $\mathbf{34}_2$ . . . $\mathbf{34}_8$, so as to drop down, with the assistance of gravity, and swing from the Z axis (depth) to the X axis (vertical) of the distribution panel 10 allowing front access to its electrical components.

Figure 6A:
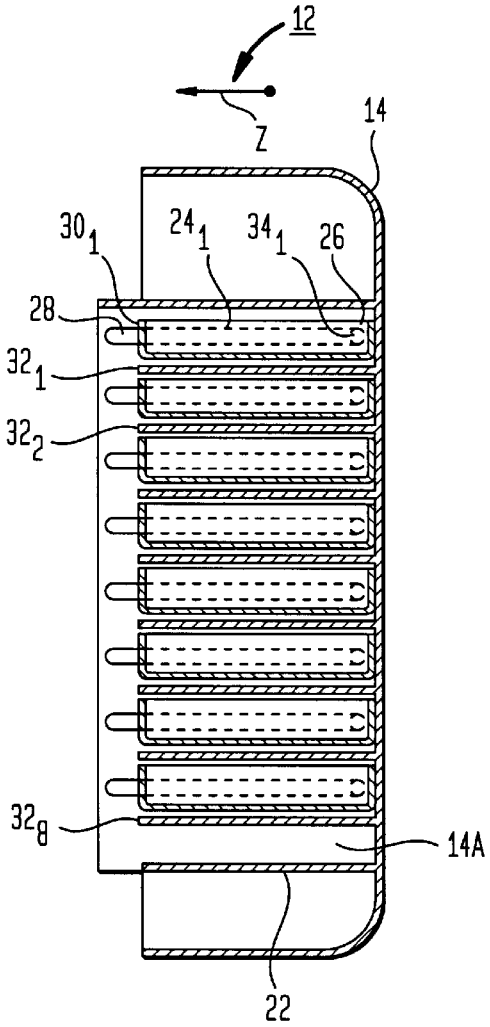
FIG. 6 is composed of FIGS. 6(A), 6(B), 6(C), and 6(D) and schematically illustrates one of the drawers of the distribution panel of FIG. 1 being pulled out along the Z axis of the distribution panel and allowed to rotate, assisted by gravity, so that it achieves a position along the X axis of the distribution panel allowing front access to the electrical components carried in the drawer.
Figure 6B:
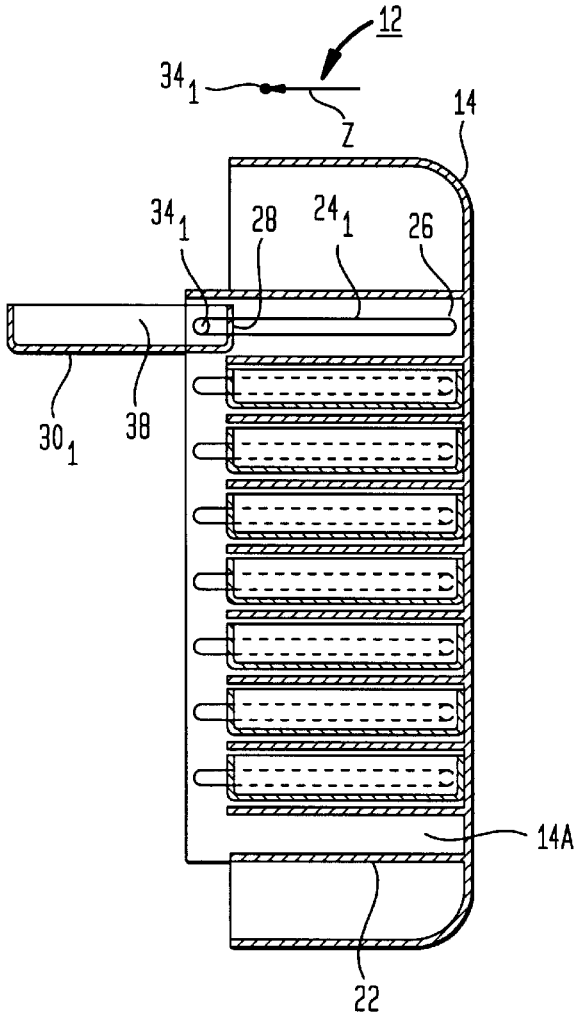
Figure 6C:
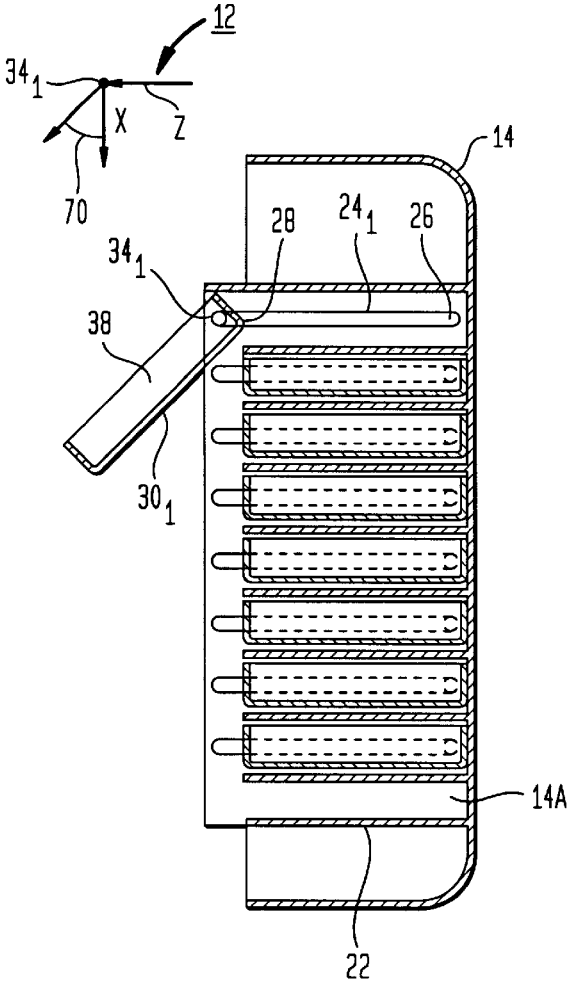
Figure 6D:
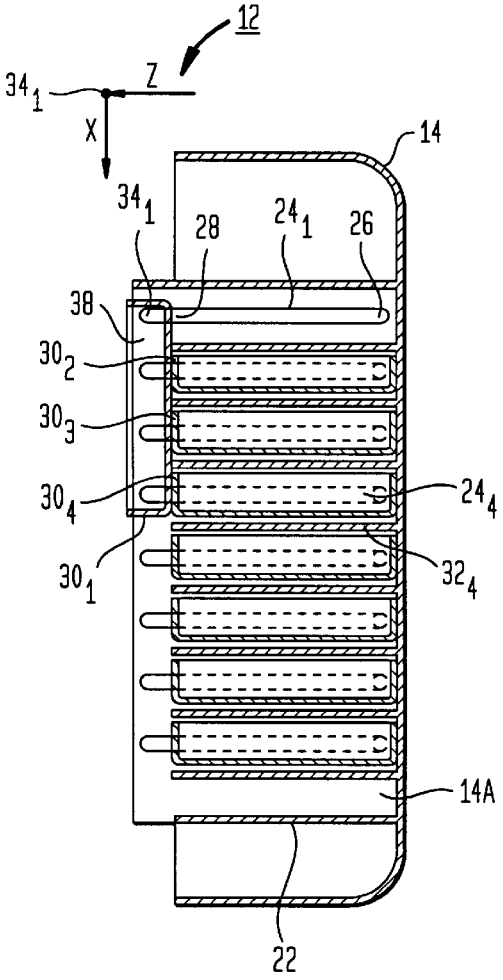

FIG. 6(A), as well as FIG. 6(B), 6(C), and 6(D), illustrates a cross section of the $\mathbf{30}_1$, $\mathbf{30}_2$, . . . $\mathbf{30}_8$, taken along the X axis (vertical) of the distribution panel 10 and looking toward the pins $\mathbf{34}_1$, $\mathbf{34}_2$ . . . $\mathbf{34}_8$ as viewed in FIG. 1 and with the pins $\mathbf{34}_1$, $\mathbf{34}_2$ . . . $\mathbf{34}_8$, having the orientation shown in FIG. 1, that is, all of the pins $\mathbf{34}_1$, $\mathbf{34}_2$ . . . $\mathbf{34}_8$ are initially at the first end 26 of their respective slot $\mathbf{24}_1$, $\mathbf{24}_2$ . . . $\mathbf{24}_8$. Further still, the pins $\mathbf{34}_1$, $\mathbf{34}_2$, . . . $\mathbf{34}_8$, more particularly, the screws heads 68A are above the top surface of the respective slot $\mathbf{24}_1$, $\mathbf{24}_2$ . . . $\mathbf{24}_3$, and are tightened downward so that the respective drawer $\mathbf{30}_1$, $\mathbf{30}_2$, . . . $\mathbf{30}_8$, are not touching any of their adjacent dividers $\mathbf{32}_1$, $\mathbf{32}_2$, . . . $\mathbf{32}_8$. FIG. 6(A) illustrates that the slots $\mathbf{24}_1$, $\mathbf{24}_2$, . . . $\mathbf{24}_8$, run along the Z-axis (depth) of the distribution panel 10. To allow the movement of any of the drawers $\mathbf{30}_1$, $\mathbf{30}_2$, . . . $\mathbf{30}_8$, the respective screw head 68A for the respective pin, such as $\mathbf{34}_1$, is loosened and the drawer 30 are gripped adjacent to the openings $\mathbf{36}_1$ (as shown in FIG. 9) to allow the drawer $\mathbf{30}_1$ to be moved along the Z axis (depth) from the first end 26 to the second end 28 of the slot $\mathbf{24}_1$ and which may be further described with reference to FIG. 6(B).

FIG. 6(B) illustrates that the drawer $\mathbf{30}_1$ has been moved along its slot $\mathbf{24}_1$, running along the Z-axis (depth) of the distribution panel 10 so that the pin $\mathbf{34}_1$ is now at the second end 28 of the slot $\mathbf{24}_1$. When the drawer $\mathbf{30}_1$ is at this location, its grip thereof is released allowing the drawer $\mathbf{30}_1$ to fall in a downward direction, assisted by gravity, but preferably (guided by a servicing technician, toward the remaining attached drawers $\mathbf{30}_2$ . . . $\mathbf{30}_8$, and which may be further described with reference to FIG. 6(C).

FIG. 6(C) illustrates the drawer $\mathbf{30}_1$ as rotating about the pin $\mathbf{34}_1$ (as shown in X-Y-Z orientation 12) in a direction 70 which is toward the X-axis (vertical) of the distribution panel 10. The drawer $\mathbf{30}_1$ falls because of its own weight and is allowed to come to rest against the remaining attached drawers, more particularly, the attached drawers $\mathbf{30}_2$, $\mathbf{30}_3$ and $\mathbf{30}_4$ and dividers $\mathbf{32}_1$, $\mathbf{32}_2$ and $\mathbf{32}_3$, which may be further described with reference to FIG. 6(D).

FIG. 6(D) illustrates that the pin $\mathbf{34}_1$ is at the second end 28 of the slot $\mathbf{24}_1$, but that drawer $\mathbf{30}_1$, is resting against the attached drawers $\mathbf{30}_2$, $\mathbf{30}_3$ and $\mathbf{30}_4$ and dividers $\mathbf{32}_1$, $\mathbf{32}_2$ and $\mathbf{32}_3$. At this orientation, the components mounted on the drawer $\mathbf{30}_1$ are provided with front access by a servicing technician and may be further described with reference to FIG. 7. Similarly, when drawer $\mathbf{30}_2$ is laid down (not shown), it would be supported by drawers $\mathbf{30}_3$, $\mathbf{30}_4$ and $\mathbf{30}_5$ and dividers $\mathbf{32}_2$, $\mathbf{32}_3$ and $\mathbf{32}_4$. It is noted that although not all of the drawers can be laid down simultaneously for the configuration of the distribution panel 10 as shown, at most two drawers (e.g. $\mathbf{30}_1$ and $\mathbf{30}_5$) can be laid down and components thereon being accessible. However, a distribution panel 10 having different size or differently spaced drawers may provide more or less accessibility.

Figure 7:
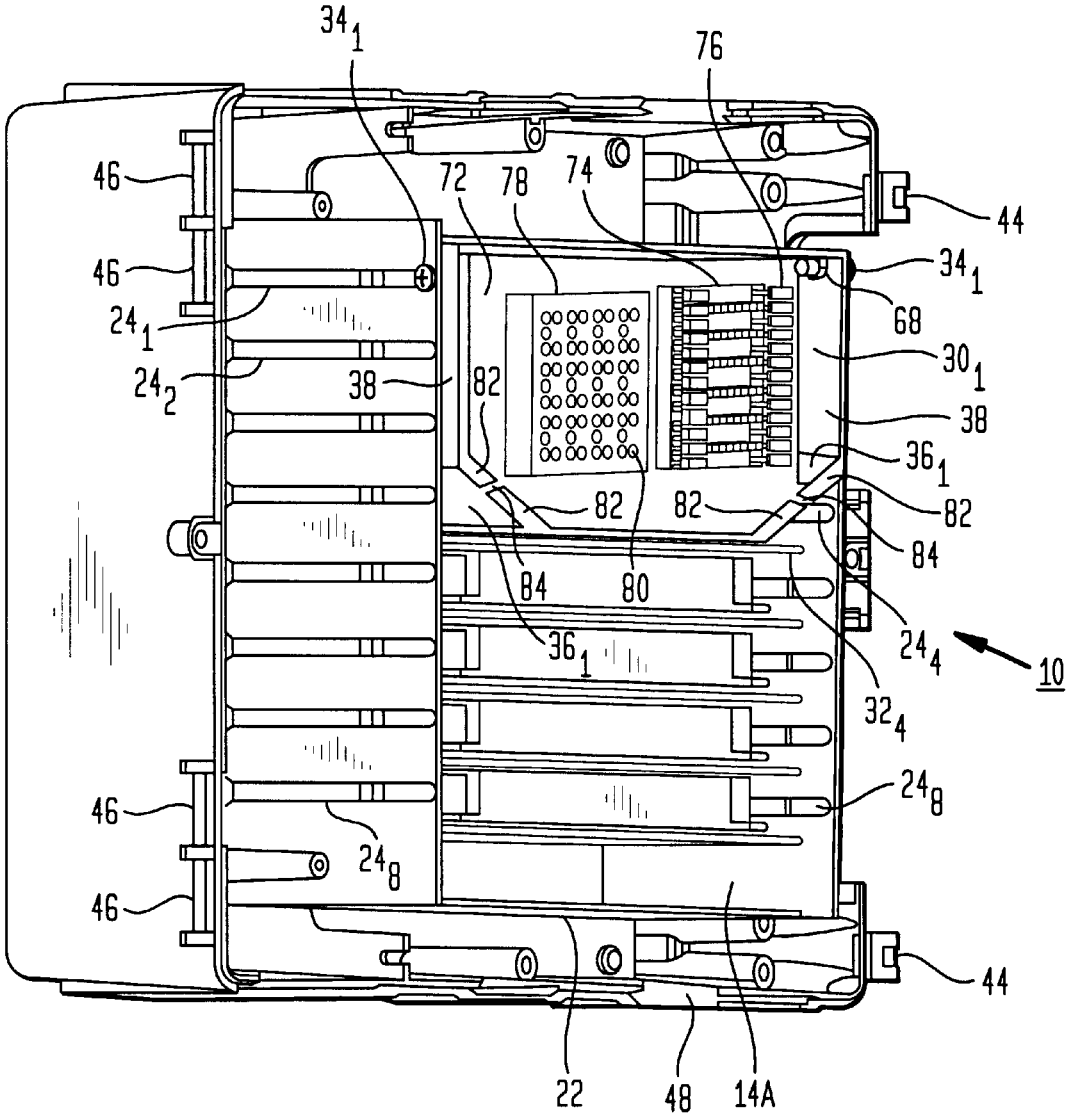
FIG. 7 illustrates the pulled out and laid down drawer having the orientation of FIG. 6(D)

FIG. 7 illustrates that the drawer $\mathbf{30}_1$ is laid down and provides front access to electrical components, while at the same time providing rigid support so that a press-action tool may be readily used to provide good electrical connection of associated electrical cables. More particularly, the drawer $\mathbf{30}_1$ has a surface 72 located on its inner face on which is mounted terminal block 74 having terminals 76 and terminal block 78 having openings 80.

From FIG. 7, it may be envisioned that the terminal blocks 74 and 78 have a rigid support surface 72 so that tools having a downward force may be used to interconnect electrical wires or optical cables to their associated terminal blocks 74 or 78 by using a relatively severe force along the Z-axis (depth), thereby, allowing for a good electrical connection to be provided for the associated electrical conductors.

FIG. 7 further illustrates the two openings $\mathbf{36}_1$ with each of the drawers 30, preferably having mounted thereat stem portions 82 that are spaced apart from each other so as to provide for an opening 84. This opening 84 is beneficial for dressing the cable runs, which will be further described with reference to FIG. 9. Features of the terminal block 74 may be further described with reference to FIG. 8.

Figure 8:
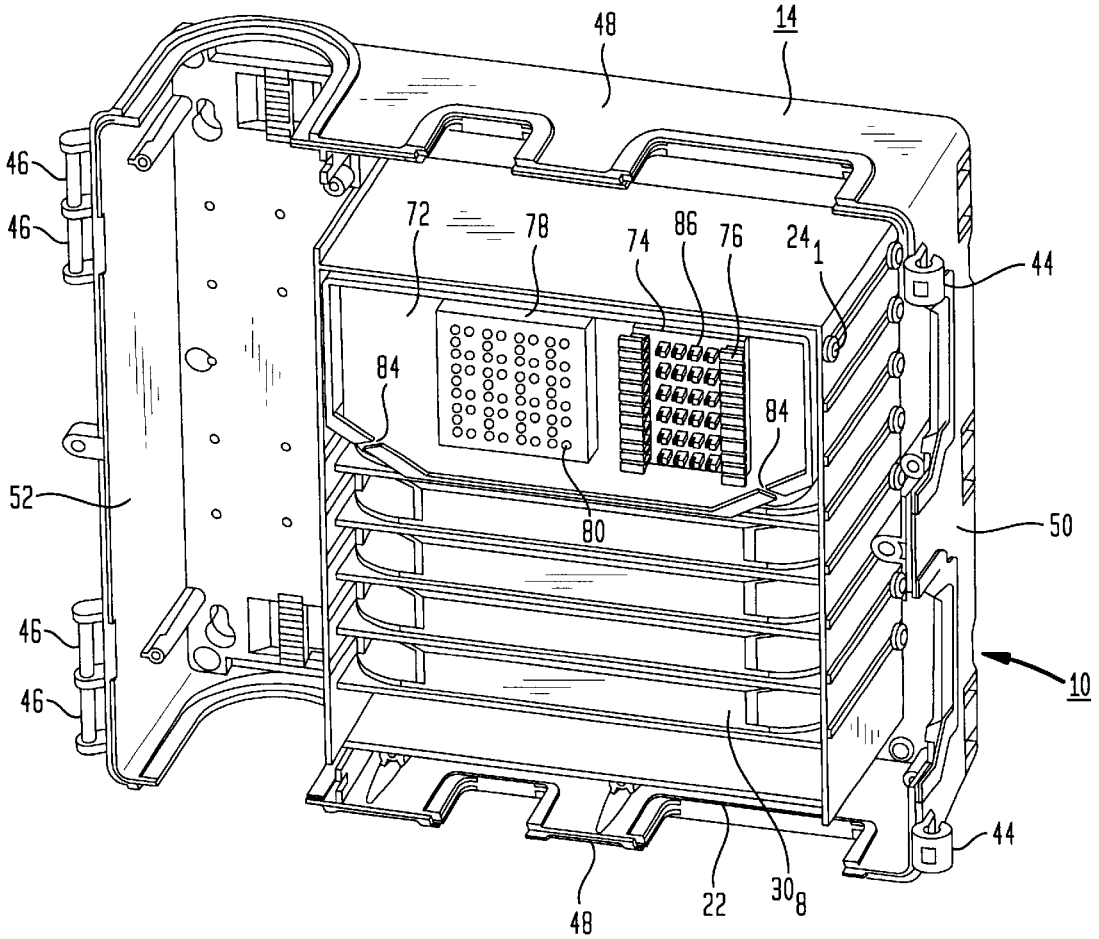
FIG. 8 is similar to FIG. 7, but illustrates further features of the electrical components mounted on the pulled out and dropped down drawer.

FIG. 8 illustrates that the terminal blocks 74 carries with it terminals 86 that accommodate electrical wire connections. A review of the terminals 86 reveals that a substantial press-action by a servicing technician may be required to force fit the associated electrical wires into the terminals 86. The electrical wires, as well as optical cable all in appropriate cable runs, may be further described with reference to FIG. 9.

Figure 9:
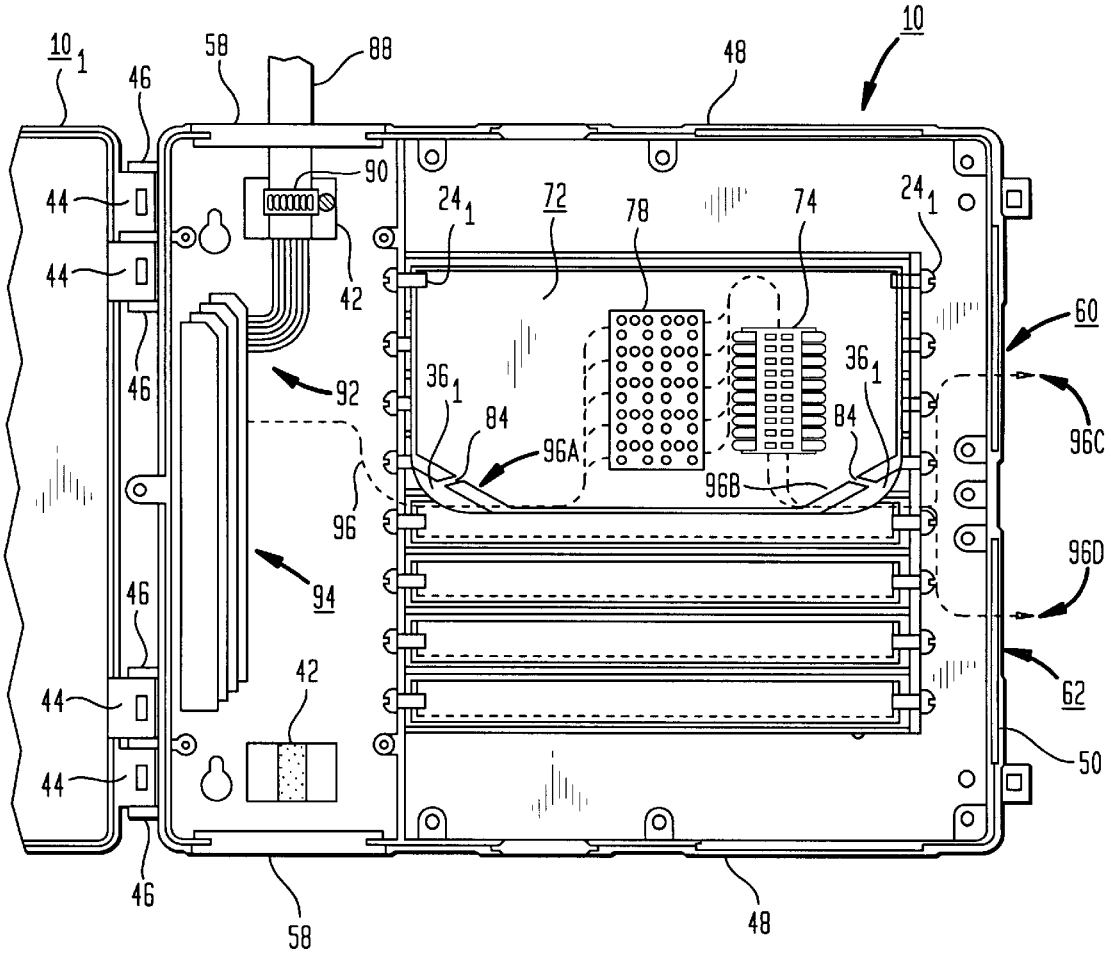
FIG. 9 generally illustrates the wiring associated with the electrical components mounted on the drawers of the distribution panel of FIG. 1.

FIG. 9 illustrates a cable run comprising a cable 88 entering the opening 58 of one of the side portion 48. The cable run 88 has a cable tie 90 which is connected to support bracket 42 and comprises a plurality of electrical and optical cables, generally indicated by reference number 92, that are interconnected to input connectors 94. The electrical components on terminal block 74 and 78 are interconnected to the cable run 88 and to the input connectors 94 by means of a cable run 96.

It should be noted that cable run 96 should be provided with sufficient slack so that the front accessible interconnected electrical components on terminal blocks 74 and 78 and mounted in the drawer, such as drawer, $\mathbf{30}_1$ allow the drawer $\mathbf{30}_1$, to be moved along the slot $\mathbf{24}_1$ and folded out in a manner as described for FIG. 6 and as shown in FIG. 9. The cable run 96 enters into one of the two openings $\mathbf{36}_1$ shown in FIG. 9 as section 96A of cable run 96 and then is routed to the terminal blocks 74 and 78 and exits therefrom at the other opening $\mathbf{36}_1$ shown in FIG. 9 as section 96B which, in turn, passes to either sections 96C or section 96D that respectively exit the opening 60 and 62 of the top portion 50.

As further seen in FIG. 9, the distribution panel 10 may be joined to similar distribution panels or a cover such as $\mathbf{10}_1$ by means of hook members 44 being interconnected to hinge members 46. Although FIG. 9 shows the front-access exposure of only one drawer $\mathbf{30}_1$, additional drawers may be front-accessed exposed in a manner as may be described with reference to FIG. 10.

Figure 10:
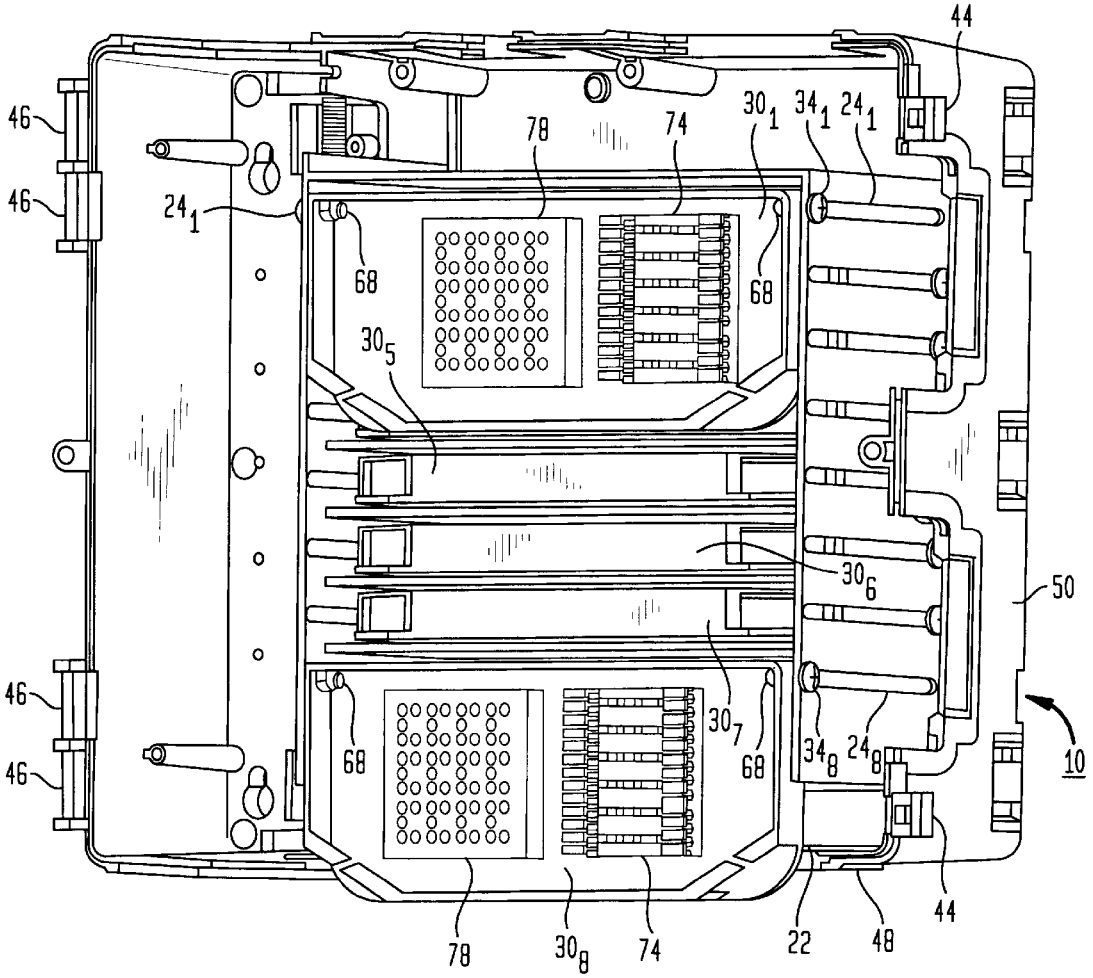
FIG. 10 is similar to FIG. 7, but illustrates two drawers pulled out and laid down so as to provide front access to the electrical components mounted thereon.

FIG. 10 is similar to FIG. 7 and shows that in addition to the first drawer $\mathbf{30}_1$, additional drawers, such as $\mathbf{30}_8$ may be moved along its respective channel $\mathbf{24}_8$, and allowed to drop down along the X-axis (vertical) so as to be exposed in a manner as shown in FIG. 10, whereby the drawer $\mathbf{30}_8$ is resting on the side 22 of the fixture 14, as well as resting on side portion 48 of the distribution panel 10. From FIG. 10, it is envisioned that the technician servicing the distribution panel is provided with front-access to any of the electrical components on any of the drawers $\mathbf{30}_1$, $\mathbf{30}_2$ . . . $\mathbf{30}_8$ and also is provided with a rigid surface to successfully use press action to establish good electrical connections.

It should now be appreciated that the practice of the present invention provides for a distribution panel that has a multiplicity of drawers to allow the servicing of a multiplicity of subscribers, while at the same time providing front access to its electrical components so as to ease the burden of the servicing( technician to maintain and update the electrical functions of the distribution panel 10.

Various additional modifications will become apparent to those skilled in the art. All such variations, which basically rely on the teaching to which this invention has advanced the art, are properly considered within the scope of the invention.

What I claim is:

1. A distribution panel having X-Y-Z axes, in a vertical-horizontal-depth orientation respectively, servicing a multiplicity of subscribers and holding electrical components, comprising:

a) a housing;

b) a fixture mounted to said housing and having at least one side with at least one slot running along the Z axis of said distribution panel having a first and a second end; and c) at least one drawer arranged slidably in said fixture to slide along said Z axis of said distribution panel, each of said at least one drawer having an inner surface for mounting the electrical components thereon, at least one sidewall extending vertically from said inner surface and a pin extending horizontally from said at least one sidewall inserted into said at least one slot and dimensioned so as to be capable of sliding along said at least one slot from said first end to said second end when one of said at least one drawer is being pulled along said Z axis such that one of said at least one drawer drops downward toward said X axis of said distribution panel and rotates about said pin at said second end.

2. The distribution panel according to claim 1 wherein said pin comprises a screw head for engaging said at least one slot.

3. The distribution panel according to claim 1, the distribution panel further having at least one sidewall, further comprises a cover mounted on one of said sidewall for enclosing said fixture and said at least one drawer.

4. The distribution panel according to claim 3 further comprises hook and hinge arrangements on one of said sidewall of the distribution panel for being releasably mounted to other distribution panels.

5. The distribution panel according to claim 4 further comprises electrical components mounted on said at least one drawer and cable runs on one of said sidewall of the distribution panel for interconnecting to said electrical components.

6. The distribution panel according to claim 5, wherein said cable runs comprise fiber optical and electrical cables.

7. The distribution panel according to claim 5 further comprises at least one opening on one of said sidewall of the distribution panel for allowing ingress and egress of said cable runs.

8. The distribution panel according to claim 5 wherein each of said at least one drawer having first and second portions with said pin extending from said first portion and said second portion for gripping said at least one drawer to pull it along said Z-axis.

9. The distribution panel according to claim 8 wherein said at least one drawer further comprises at least one opening at said second portion for allowing ingress and egress of said cable runs.

10. The distribution panel according to claim 1 further comprising electrical terminals mounted on said at least one drawer.

11. The distribution panel according to claim 1, wherein said fixture having first and second oppositely opposed sides and each of said at least one drawer being interposed between said first and second sides, each of said at least one drawer having two oppositely opposed sidewalls, each of said sidewall of each of said at least one drawer having a pin inserted into said first end of each of said at least one slot of said oppositely opposed sides of said fixture.

12. The distribution panel according to claim 1, further comprising mounts for tying connecting cable ties.

13. The distribution panel according to claim 1 wherein said at least one drawer comprises a plurality of drawers adjacently stacked and said fixture further comprises at least one divider placed between each adjacent pair of said plurality of adjacently stacked drawers such that when one of said plurality of adjacently stacked drawers drops downward towards said X axis of said distribution panel it is supported by one or more of said at least one divider.

* * * * *